United States Patent [19]

Plemmons et al.

[11] 4,255,781

[45] Mar. 10, 1981

[54] LUMINAIRE LATCH DEVICE

[75] Inventors: Jerry R. Plemmons, Asheville; Walter R. Blake, Hendersonville, both of N.C.

[73] Assignee: General Electric Company, Schenectady, N.Y.

[21] Appl. No.: 60,584

[22] Filed: Jul. 25, 1979

[51] Int. Cl.[3] ..... F21V 17/00

[52] U.S. Cl. ..... 362/374; 220/326; 362/364; 362/375

[58] Field of Search ..... 220/334, 326, 315; 362/364, 374, 375, 330; 292/131, 87

[56] References Cited

U.S. PATENT DOCUMENTS

| | | | |
|---|---|---|---|
| 2,938,112 | 5/1960 | Dvorak | 220/326 X |
| 3,070,691 | 12/1962 | Relich | 362/364 |
| 3,334,770 | 8/1967 | Stanback | 220/326 |
| 3,353,015 | 11/1967 | Franklin | 362/374 X |
| 3,604,921 | 9/1971 | Wood | 362/374 X |

*Primary Examiner*—George T. Hall

*Attorney, Agent, or Firm*—Sidney Greenberg; Lawrence R. Kempton; Philip L. Schlamp

[57] ABSTRACT

Latch device for hinged luminaire door comprises a pair of spaced spring steel members attached at their upper ends to the luminaire housing. At their lower ends the spring members are formed with ledges for releasably holding the luminaire door in closed position. A latch bar interconnecting the spaced spring members at their lower ends is movable to disengage the spring members from the door to allow it to swing open.

10 Claims, 4 Drawing Figures

Fig. 1
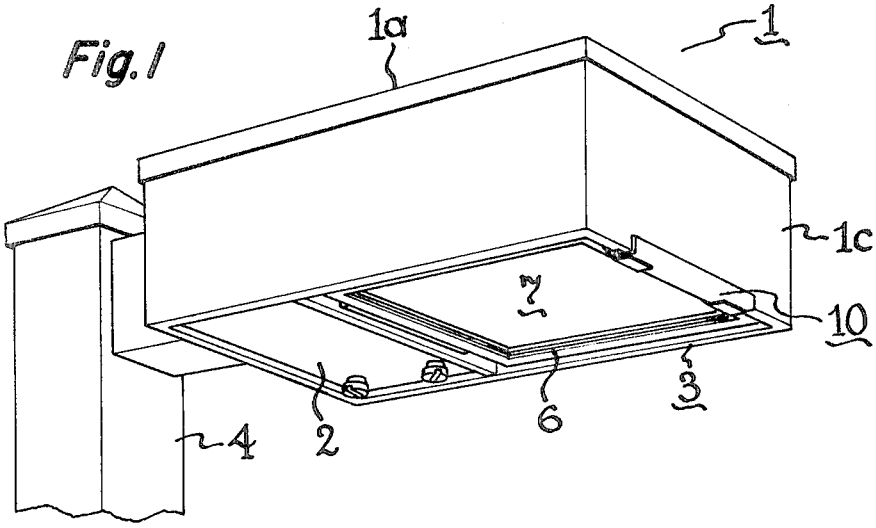
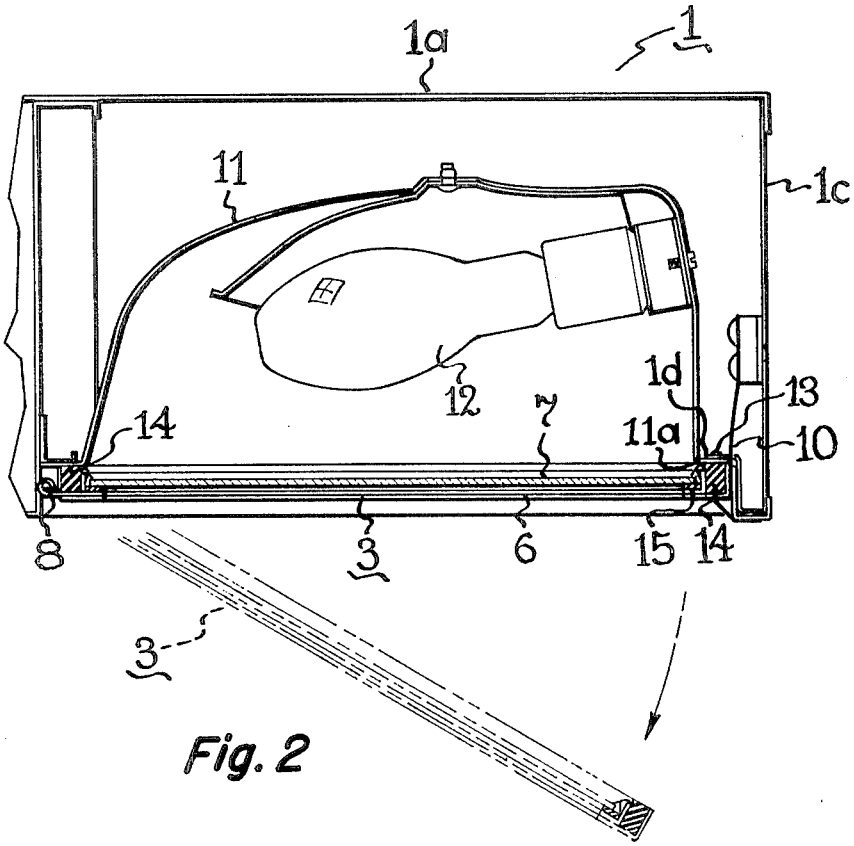
Fig. 2

Fig. 3
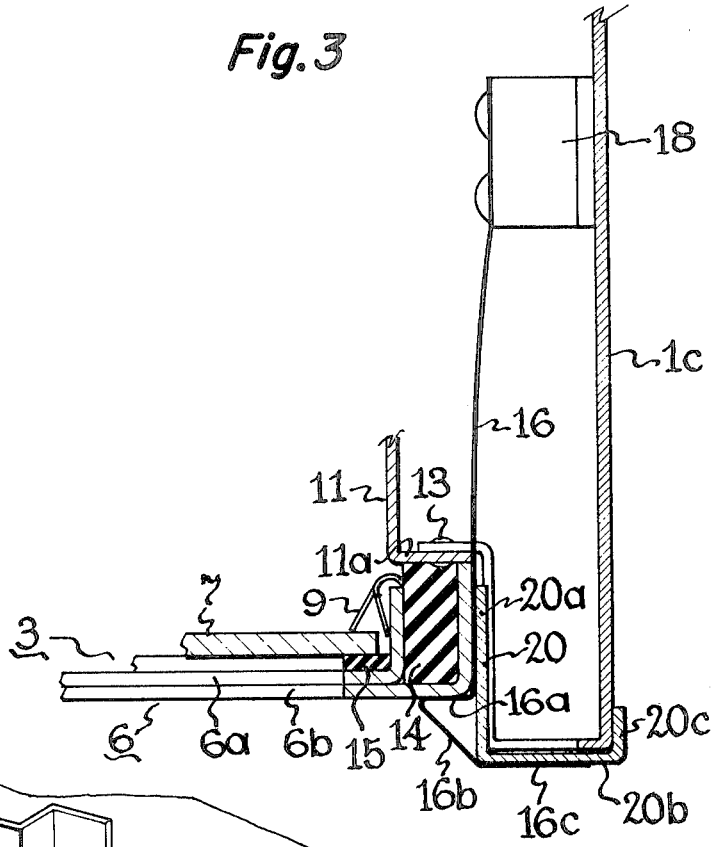
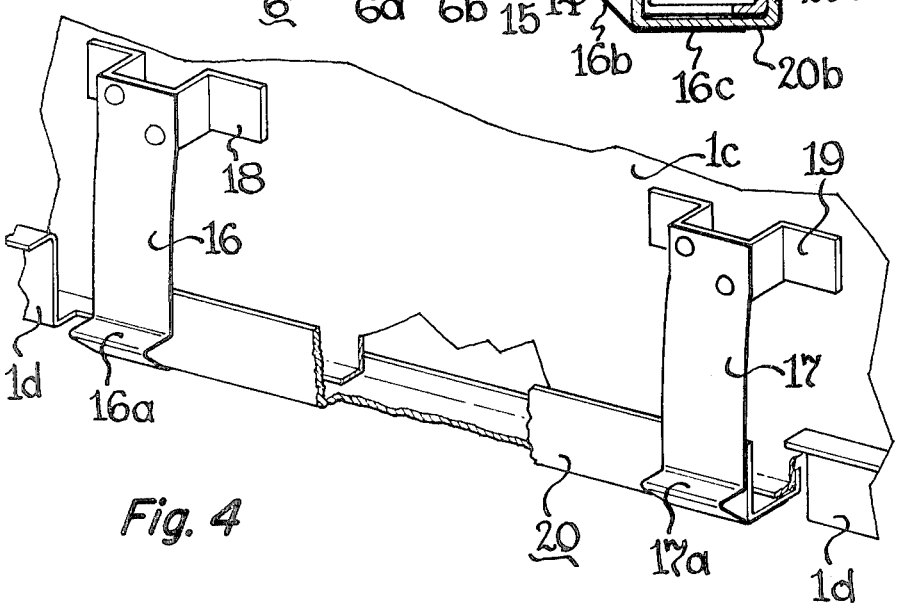
Fig. 4

LUMINAIRE LATCH DEVICE

The present invention relates to a latch device and more particularly to a latching structure adapted for releasably fastening a closure to a luminaire housing.

It is an object of the invention to provide an improved latch device which is simple in construction, readily and economically manufactured and installed, and is reliable in operation for securely fastening the parts of a closure assembly together while being easily manipulated for opening and closing the same without the use of tools.

Another object of the invention is to provide a latch device of the above type for fastening the door of a luminaire to the luminaire housing wherein the latch device maintains the aesthetic appearance of the luminaire.

Still another object of the invention is to provide a latch device of the above type which is particularly suitable for use with luminaires having sheet metal housings.

Other objects and advantages will become apparent from the following description and the appended claims.

With the above objects in view, the present invention in one of its aspects relates to a closure device comprising, in combination, a housing having side walls defining a bottom opening, closure means mounted on said housing for movement between a closed position covering said bottom opening and an open position away from said opening, and latch means for detachably holding said closure means in closed position, said latch means comprising a pair of spaced elongated spring members having upper ends secured to one of said housing walls inwardly of said opening and having lower ends extending exteriorly of said opening, said spring members being formed with retaining portions adjacent said bottom opening and being biased inwardly away from said one wall for engagement of said retaining portions with said closure means, and a bar member extending between and secured to said exterior lower ends of said spring members, said bar member being operable for simultaneously moving said spring members outwardly for detaching said closure means from said housing.

The invention will be better understood from the following description taken in conjunction with the accompanying drawings, in which:

FIG. 1 is a perspective view of a luminaire embodying the invention;

FIG. 2 is an elevational view, partly in section, of the luminaire;

FIG. 3 is an enlarged detail view, partly in section, of the latch and closure assembly shown in FIG. 2; and FIG. 4 is a perspective view of the latch device secured to the luminaire housing wall, with parts broken away.

Referring now to the drawings, and particularly to FIGS. 1 and 2, there is shown an outdoor luminaire in which the invention is embodied comprising a rectangular box-like housing 1, typically formed of sheet metal such as steel. Housing 1 is constituted in the illustrated embodiment of a closed top 1*a* and depending walls, of which side wall 1*b* and front wall 1*c* are shown, defining a rear bottom opening covered by panel 2 and a front bottom opening covered by closure 3. Luminaire housing 1 is mounted at its rear end on pole 4 by suitable bracket means. Closure or door 3 comprises frame 6 in which light transmitting panel 7, such as a plain or refractive glass pane, is mounted and which is hingedly secured at its rear to housing 1 by hinge pins 8 at opposite sides. Door 3 is releasably held in closed position by latch device 10, which is more fully described below.

While panel 7 is shown as a flat glass pane, it will be understood that other forms of light transmitting closures may be used, such as a dished or bowl-shaped glass or plastic member.

Arranged in the interior of luminaire housing 1 facing the bottom opening is concave reflector 11 within which is mounted lamp 12. Reflector 11 is formed at its rim with a flange 11*a* by which the reflector is secured to an inwardly projecting flange of the housing, by means of rivets 13 or the like.

As seen best in FIG. 3, door frame 6 in the illustrated embodiment comprises superposed frame members 6*a*, 6*b* formed with upstanding flanges spaced from each other so as to form a channel extending around the frame in which sealing gasket 14 is seated, the arrangement being such that gasket 14 is in resilient sealing relation with reflector flange 11*a* when door 3 is in closed position, as shown.

Glass panel 7 is arranged overlying frame 6 inwardly of the spaced flanges, with a suitable sealing gasket 15, adhesively attached to frame 6, being interposed between the outer margin of panel 7 and the mating surface of frame 6. Clips 9 spaced around frame 6 hold pane 7 in assembly with the frame.

As seen in FIG. 3, door 3 is held in closed position by the latch device of the invention, which in the illustrated embodiment comprises a pair of spaced strip-shaped, spring steel members 16, 17 (see FIG. 4) secured at their upper ends to, but spaced from, the inner side of front housing wall 1*c* by U-shaped brackets 18, 19 which are spot welded or otherwise suitably attached to housing wall 1*c*. The intermediate portion of each latch spring (see FIG. 3) is bent inwardly as shown so as to be biased toward the door 3, and each is formed with a ledge portion 16*a* near its bottom end on which the door frame 6 is adapted to rest when in closed position. Below ledge portion 16*a* the spring is formed with a downwardly and outwardly sloped portion 16*b* and a bottom end portion 16*c* which extends outwardly therefrom in a plane generally normal to the principal plane of the spring strip.

In accordance with the invention, an elongated bar 20, which is typically made of metal such as stainless steel and is somewhat L-shaped in cross-section, is arranged extending between and secured to both springs 16, 17, as seen in FIG. 4. Bar 20 is formed (see FIG. 3) with an upstanding arm 20*a* secured, as by spot welding, to the intermediate portion of each spring strip 16, 17, a bottom web portion 20*b* welded or otherwise secured to the bottom portion 16*c* of each spring strip, and an outer upstanding arm or flange 20*c* which is shorter than inner arm 20*a* and which, in the closed position of door 3, extends upwardly in contact with the outer side of housing wall 1*c*.

As best seen in FIG. 4, from which reflector 11 and door 3 have been omitted for purposes of clarity, housing front wall 1*c* is integrally formed with a somewhat Z-shaped flange 1*d* projecting inwardly therefrom, flange 1*d* being cut out along the region of the described latch device so as to accommodate the latter and allow its operation as described below.

To open door 3, bar 20 is grasped on its inner surface by one hand and moved outwardly against the bias of the two latch springs 16, 17 until the ledge portions 16*a*, 17*a* clear the edge of the door, allowing the door to drop open as it swings about its hinge 8. Preferably, the door is supported by the other hand as it drops down. Latch bar 20 is then released, allowing the latch device to return to its original (normal) position by the force of the spring bias. The inward travel of the latch device is limited, as indicated previously, by contact of outer flange 20*c* with the housing wall 1*c*.

With door 3 thus hanging in its open position, access is provided for relamping or other servicing of the luminaire. To close the door, it is swung upwardly until the frame comes into contact with slope portion 16*b*, 17*b* of the latch springs and rides along those portions as the springs are thereby moved outwardly away from the path of the door. When the door reaches its fully closed position with gasket 14 and the outer frame edge abutting reflector flange 11*a*, latches 16, 17 spring inwardly so that ledges 16*a*, 17*a* underlie and retain door 3 in the closed position, as shown in FIG. 3.

Latch bar 20 in the described assembly has a number of functions. It serves as a stiffening member to keep the latch springs properly oriented and undistorted. It covers the cut-out portion of the luminaire housing and thereby contributes to the aesthetic appearance of the unit. Also, by interconnecting the two spaced latch members it enables both latches to be simultaneously operated by one hand, leaving the other hand free to support the door as it swings down.

The provision of two spaced latches in accordance with the invention is particularly advantageous for sheet metal housings, since in such applications a better seal between the door frame and the housing is ensured, as compared to a single latch arrangement.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim and desire to secure by Letters Patent of the United States is:

1. A closure device comprising, in combination, a housing having side walls defining a bottom opening, closure means mounted on said housing for movement between a closed position covering said bottom opening and an open position away from said opening, and latch means for detachably holding said closure means in closed position, said latch means comprising a pair of spaced elongated spring members having upper ends secured to one of said housing walls inwardly of said opening and having lower ends extending exteriorly of said opening, said spring members being formed with retaining portions adjacent said bottom opening and being biased inwardly away from said one wall for engagement of said retaining portions with said closure means, and a bar member extending between and secured to said exterior lower ends of said spring members, said bar member being operable for simultaneously moving said spring members outwardly for detaching said closure means from said housing.

2. A device as defined in claim 1, said spring members formed below said retaining portions with sloped portions co-acting with said closure means for moving said spring members out of the path of said closure means during movement of the latter to closed position.

3. A device as defined in claim 1, said bar member having means for limiting the inward movement of said latch means.

4. A device as defined in claim 1, said retaining portions comprising ledges formed in said spring members projecting inwardly therefrom, said closure means resting on said ledges while in closed position.

5. A device as defined in claim 3, said bar member being somewhat L-shaped in cross-section, said limiting means comprising a flange along the outer side of said bar member engaging said one wall of said housing.

6. A device as defined in claim 5, said closure means comprising a light transmitting door hingedly connected at one side to said housing for swinging movement between said open and closed positions and held at an opposite side by said retaining portions in said closed position, said spring members formed below said retaining portions with sloped portions co-acting with said opposite side of said door for moving said spring members out of the path of said door during movement of the latter to said closed position.

7. A device as defined in claim 1, said one wall of said housing being formed with inwardly directed flange means extending along said wall, said flange means formed with an elongated opening in the region of said latch means for accommodating the latter, said bar member in normal position substantially covering said elongated opening.

8. A device as defined in claim 1, said housing being substantially rectangular and formed substantially of sheet metal.

9. A luminaire comprising, in combination, a housing having a top wall and side walls forming an enclosure, said side walls defining a bottom opening, a reflector mounted within said housing enclosure, means for mounting a light source in said enclosure adjacent said reflector, closure means mounted on said housing for movement between a closed position covering said bottom opening and an open position away from said opening, and latch means for detachably holding said closure means in closed position, said latch means comprising a pair of spaced elongated spring members having upper ends secured to one of said housing walls inwardly of said opening and having lower ends extending exteriorly of said opening, said spring members being formed with retaining portions adjacent said bottom opening and being biased inwardly away from said one wall for engagement of said retaining portions with said closure means, and a bar member extending between and secured to said exterior lower ends of said spring members, said bar member being operable for simultaneously moving said spring members outwardly for detaching said closure means from said housing.

10. A luminaire as defined in claim 9, said housing being substantially rectangular and formed substantially of sheet metal.

* * * * *